US005384984A

United States Patent [19]

Smith

[11] Patent Number: 5,384,984

[45] Date of Patent: Jan. 31, 1995

[54] RANDOM ORBIT SANDER WITH BRAKE

[75] Inventor: John C. Smith, Jackson, Tenn.

[73] Assignee: Porter-Cable Corporation, Jackson, Tenn.

[21] Appl. No.: 124,930

[22] Filed: Sep. 21, 1993

Related U.S. Application Data

[63] Continuation-in-part of Ser. No. 9,309, Jan. 22, 1993.

[51] Int. Cl.[6] ..... B24B 23/00

[52] U.S. Cl. ..... 451/357; 451/344

[58] Field of Search ..... 51/170 MT, 170 R, 170 T, 51/177, 174; 188/379, 380, 378

[56] References Cited

U.S. PATENT DOCUMENTS 5,018,314 5/1991 Fushiya et al. ..... 51/170 MT

FOREIGN PATENT DOCUMENTS 2183514 6/1987 United Kingdom ..... 51/170 T

*Primary Examiner*—Maurina T. Rachuba

*Attorney, Agent, or Firm*—Merchant, Gould, Smith, Edell, Welter & Schmidt

[57] ABSTRACT

A pad sander skirt which flares out over the periphery of the sanding pad and which is coupled to a lower housing so that it swivels about the body of the sander. The skirt and lower housing can be selectively swivelled in a rotational manner to a position desired by the user. A further sander improvement disclosed relates to the protection of a user's hand. Palm-grip random orbit sanders are sometimes configured so that the sanding pad may begin spinning at high speed when the sander is lifted off of the work. To this end, the present application discloses a protective skirt which flares out over the periphery of the pad in a palm-grip random orbit sander. Also disclosed is an improved dust collection system comprising a filter housing formed of a rigid porous material for entrapping dust, as well as a braking system for use with random-orbit sanders.

23 Claims, 8 Drawing Sheets

RANDOM ORBIT SANDER WITH BRAKE

This application is a continuation in part of application Ser. No. 09/009,309 filed Jan. 22, 1993, the earlier application being assigned to the same assignee as the present application.

BACKGROUND AND SUMMARY OF THE INVENTION

The present application is directed to sander improvements. These improvements include a pad sander lower housing having a skirt which flares out over the periphery of the sanding pad. The lower housing can be selectively swivelled in a rotational manner to a position desired by the user. This has particular advantages in dustless versions of a sander in which it may be desirable to reposition the dust collection system.

A further improvement relates to the protection of a user's hand. Palm-grip random orbit sanders sometimes are configured so that the sanding pad may begin spinning at high speed when the sander is lifted off of the work. Since palm-grip random orbit sanders can be grasped by a single hand in a manner that might put the user's fingers in contact with a high speed spinning pad, protection against injury is desirable. To this end, the present application discloses a protective skirt which flares out over the periphery of the pad in a palm-grip random orbit sander. The skirt may be configured for either dustless versions of such sanders, in which case the skirt typically also forms a portion of the dust collection system, as well as with dusty versions of the sander, in which case the primary purpose of the skirt is to prevent contact of the user's hand and fingers with the pad.

In sanders with dust collectors, particularly those that use passive systems such as a cloth bag to catch dust, the dust collection apparatus can be both relatively cumbersome and ineffective. In an improvement to such passive systems, the present application discloses a sander dust collector filter housing formed of a rigid, porous material for entrapping dust. Such a dust collection system can be made in a compact manner which is particularly suitable for palm-grip sanders, whether the sander be of an orbital, dual action, or random orbit type. Larger versions of such filter housings may be used with larger sanders.

Also disclosed in the present application is a random orbit sander brake system which prevents or slows rotation of the pad when the motor is running and the pad is unconstrained by a workpiece surface while permitting the random orbit sanding motion to occur when the pad comes in contact with the workpiece surface.

DETAILED DESCRIPTION OF THE PREFERRED EMBODIMENT

Figure 1:
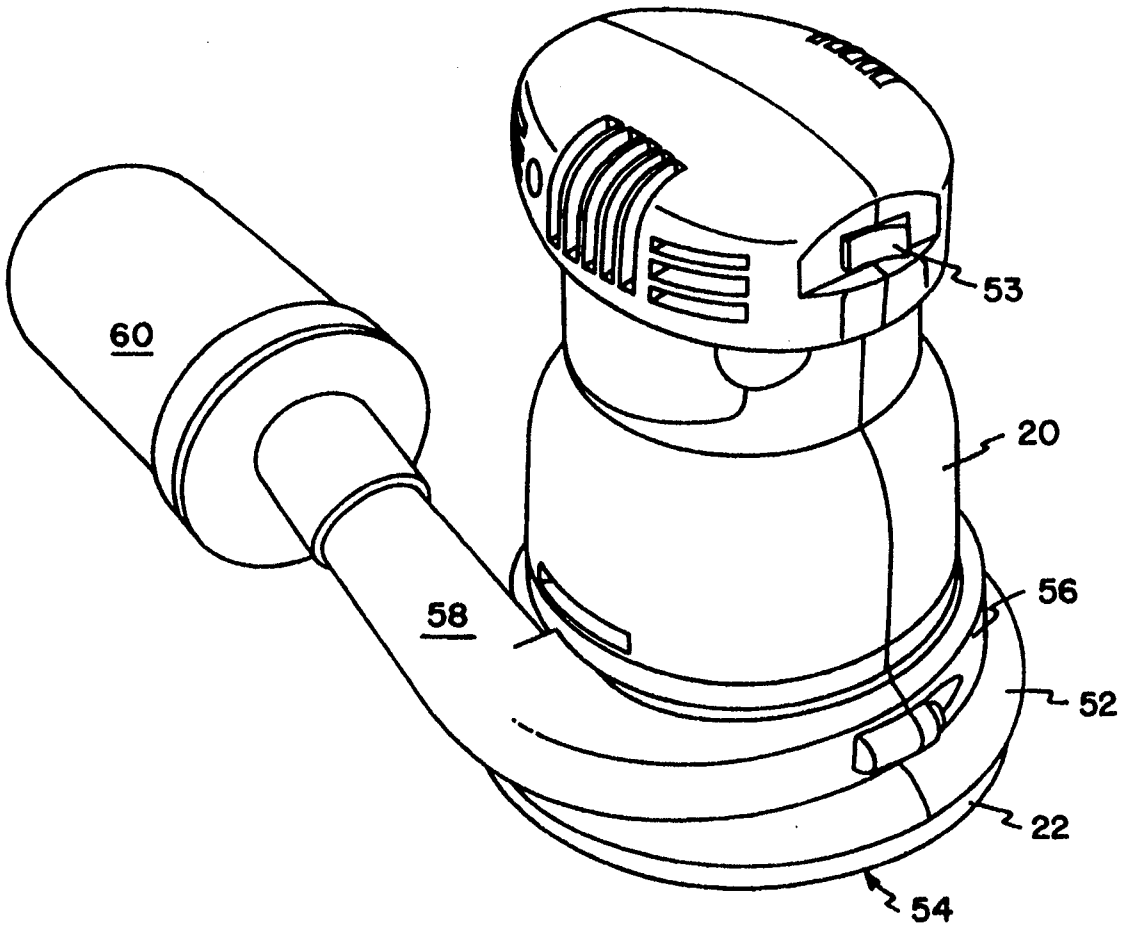
FIG. 1 is a perspective view of a sander which incorporates a dust collection system.
Figure 1A:
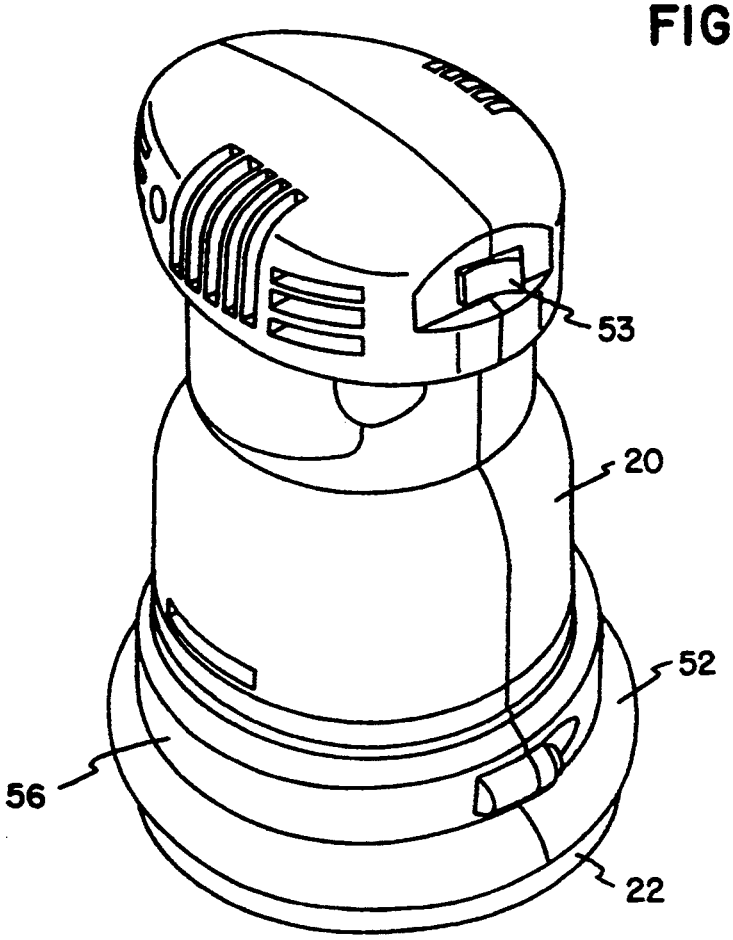
FIG. 1A illustrates a similar sander without a dust collection system.

FIG. 1 illustrates a sander having a body or housing 20 which is typically comprised of two halves secured together by conventional means and a pad 22 for holding sandpaper or other abrasives or materials (e.g., polishing pads) desired by the user. Such pads 22 can be configured in the pressure sensitive adhesive (PSA) variety as well as a hook and loop variety, each of which are familiar to those skilled in the art, and can be either with or without holes to incorporate either a sander with dust collection capability (for example, as shown in FIG. 1) or without such capability (for example, as shown in FIG. 1A). Pad 22 has an outer periphery substantially defining the size of sandpaper or other material supported by the pad.

The sanders shown in FIGS. 1 and 1A have a body or housing 20 sized for a palm grip at the top of the housing and for a single-handed grip around the body. A motor housed by body 20 typically comprises an armature 24, a field 26, and brush and spring assemblies 28. Upper and lower bearings 30 and 32 are supported by the housing and provide stability and smooth operation for motor shaft 34. For a random orbit sander of the type shown, motor shaft 34 is typically directly coupled to a counterweight 36, which may incorporate integral fan blades 37 used for dust collection.

In the embodiment shown, pad support 38 is coupled to counterweight 36 by a ball bearing 40 having its outer race diameter press fit into a cylindrical cavity 42 defined by pad support 38 and the inner diameter of its race slip fit onto an eccentrically-located cylindrical protrusion 44 of counterweight 36. The connection between counter-weight 36 and pad support 38 imparts an orbital motion to the pad support 38. Pad support 38 is shown further secured to armature shaft 34 by a machine screw 46, which ensures a secure assembly of the counterweight 36, bearing 40 and pad support 38. Pad 22 is typically secured to pad support 38 by threaded machine screws 48.

Figure 3:
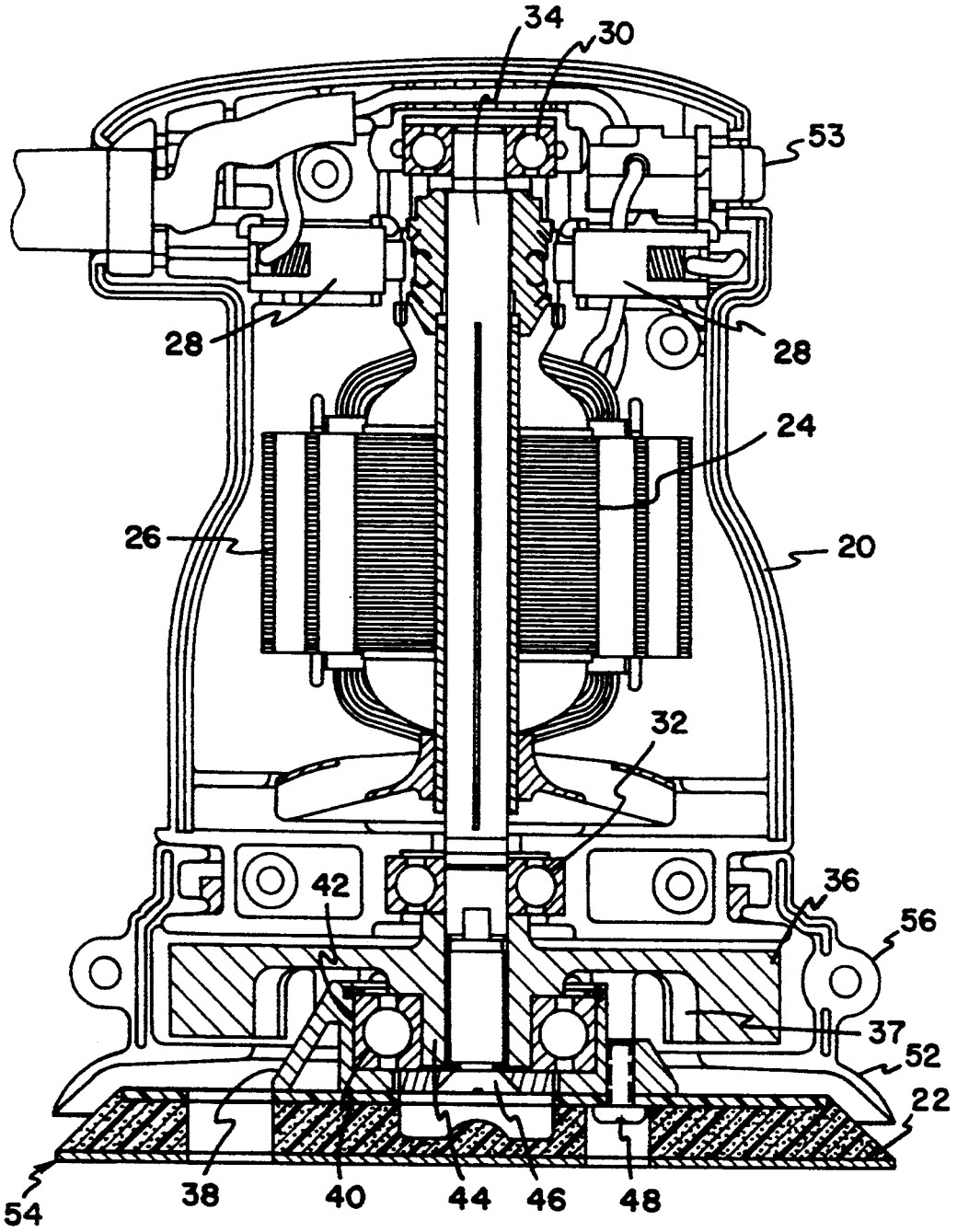
FIG. 3 shows a cross-sectional view of a sander.

As has previously been indicated, the sander motor in the embodiment shown is powered electrically and for this purpose includes a power cord 50 with power being controlled by an on/off switch 53. Those skilled in the art will recognize many other components illustrated in the cross-section of FIG. 3 as being typical to the assembly of an electrically-driven sander of a random orbit nature. Those skilled in the art will also recognize that suitable components of the sander shown could be replaced with well-known components if a sander of the orbital or dual-action variety is desired. Furthermore, in embodiments driven by an air motor, power cord 50 would be replaced by an air hose, and the components previously described which relate to an electric motor would be replaced with suitable air motor components. Motors used in the preferred embodiments have a typical no-load speed of 12,000 RPM.

For a random orbit sander which does not incorporate a braking system (e.g., one with the configuration illustrated in FIG. 3), when the sander is not in contact with the work, the rotational restraint established between the inner race, balls, seals, grease, and the outer race of the bering 40 causes the pad assembly to spin at the same speed as the motor shaft. In such an embodiment, when the abrasive or other material mounted to pad 22 contacts the work, another rotational restraint is created which opposes the bearing restraint. This additional restraint varies with pressure, abrasive grade, etc. Through this process, the rotational speed of pad 222 (i.e., of the outer race of bearing 40) is reduced to approximately 300 RPM, while the orbital motion (inner race of bearing 40) continues at a higher speed (e.g., 12,000 OPM). In this manner, since the rotational speed of the pad is not synchronized with the orbital motion of the pad, the abrasive particles are made to travel in a "random orbital motion."

In its preferred embodiment, the preferred brake system disclosed in the present application prevents rotation of pad 22 when the motor is running and the pad is unconstrained by a workpiece surface but permits the random orbit sanding motion when the pad comes in contact with the workpiece surface. The objective of a brake for use in connection with random orbit sanders is to prevent the spin up of the pad to essentially motor speed when the pad is unconstrained by a workpiece. If the pad is allowed to reach motor speed such as in a free-spinning configuration, a user may gouge or scratch the workpiece when placing the spinning pad down on the workpiece. On the other hand, if the sanding pad can be constrained from spin up prior to the time that it is placed on the workpiece, this undesirable gouging or scratching or the like can be eliminated. Furthermore, such a brake eliminates the necessity for inexperienced users to remember to place the sanding pad onto the workpiece before starting the motor in order to avoid this problem, such as in prior art sanders without a brake. In addition, the present braking system eliminates the potential for a sanding disc or the like to be flung dangerously off of a free-spinning pad, eliminates the danger of personal injury from a free-spinning pad.

Figure 7:
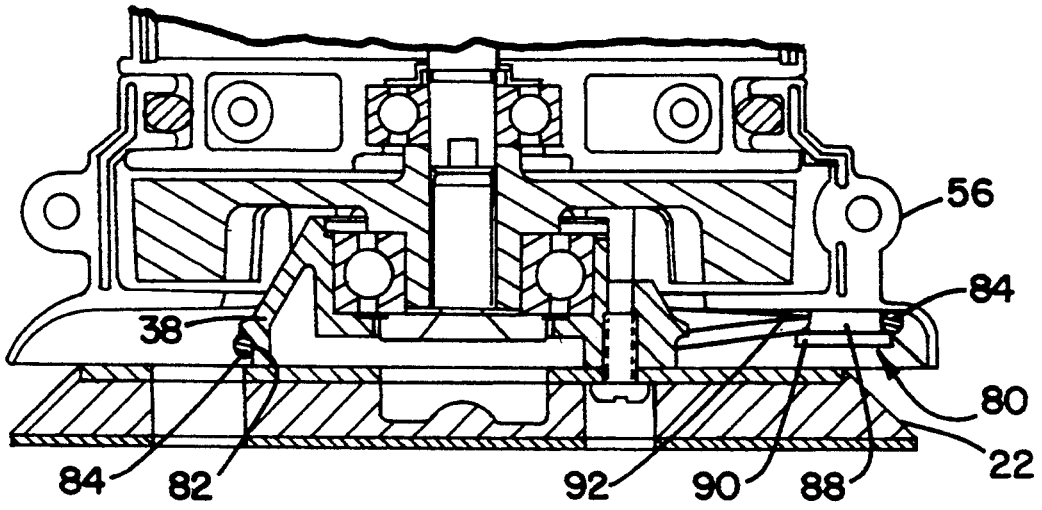
FIG. 7 illustrates a cross-sectional view of a random orbit sander incorporating a preferred embodiment of the present brake system.
Figure 8:
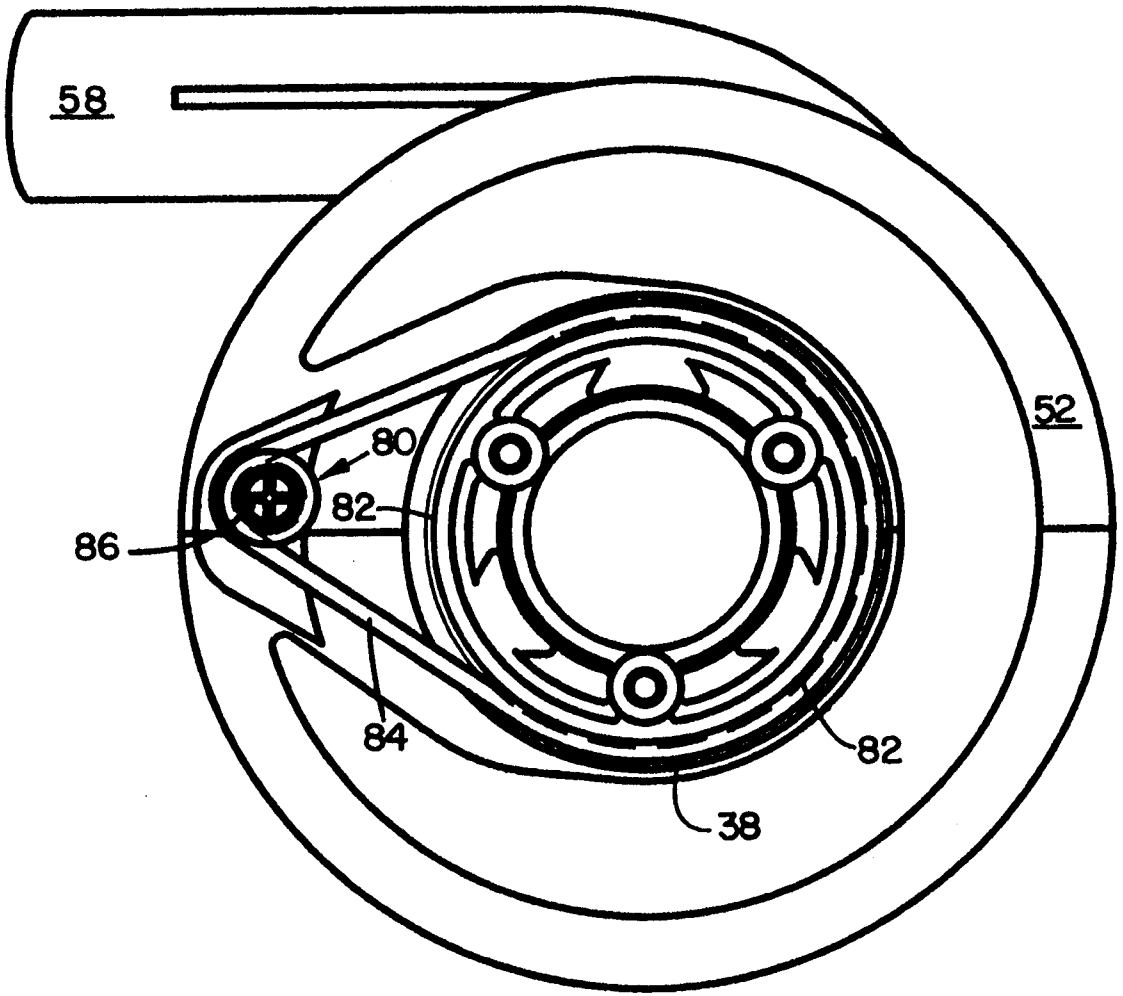
FIG. 8 is a bottom plan view of a random orbit sander which has its back-up pad removed in order to illustrate the preferred embodiment of the present brake system.

In its preferred embodiment, the preferred braking system illustrated in FIGS. 7 and 8 include a stationary fixed pulley 80 attached to a portion of the housing or body 20 such as to lower housing 56, which is further described below. A groove or recess is defined by at least one of the pad support or the pad, and in the case of the preferred embodiment, such a groove 82 is formed in the lower portion of pad support 38 adjacent the upper surface of pad 22, groove 82 being shown configured as a rabbet-shaped recess defined in the pad support. Finally, the preferred braking system includes an elastic belt 84 stretched between a groove defined by fixed pulley 80 and recess 82 defined in part by pad support 38.

In a preferred configuration, elastic belt 84 slows or preferably prevents rotation of pad support 38 (and therefore pad 22) when the sander motor is running while the pad is unconstrained (e.g., is not in contact with a workpiece surface). If it were not for elastic belt 84, during situations when sanding pad 22 is not in contact with the workpiece, the rotational restraint established between the inner race, balls, seals, grease and the outer race of pad support ball bearing 40 (which could be configured to be any other type of suitable bearing) would cause the pad assembly to spin at substantially the same speed as the motor shaft. However, when the abrasive or other material mounted to the sander pad contacts the workpiece, as with a sander without a brake, another rotational restraint is created which opposes the bearing restraint. This additional restraint varies with pressure, abrasive grade and the like. Through this process, the rotational speed of pad 22 (i.e., of the outer race of the pad support bearing) becomes approximately 300 revolutions per minute, while the orbital motion of pad support bearing inner race continues at the higher speed of the motor. In this manner, since the rotational speed of pad 22 is not synchronized with the orbital motion of the pad, the abrasive particles are made to travel in a "random orbit motion".

Consistent with this functionality, when the sander pad contacts the workpiece, the previously described rotation of the pad causes elastic belt 84 to slide across fixed pulley 80, creating a frictional resistance. This frictional resistance must be great enough so that, when the tool is lifted from the work, the resistance created by the belt will counteract the rotational resistance of the pad support bearing However, the belt force cannot be great as to impair the pad rotation when the pad is in contact with the work.

It should be noted that an elastic belt (as opposed to an inelastic belt) is necessary due to the fact that the center distance between pad support 38 and fixed pulley 80 are continually changing due to the eccentric interface between the counterweight 36 and the inner race of pad bearing 40.

In the preferred embodiment, elastic belt 84 preferably comprises 83A pyrathane polyester polyurethane, it being recognized that those skilled in the art could employ other polyethylenes or plastics or the like to form belt 84. Preferred belt 84 has a diameter of 0.13 inch plus or minus 0.003 inch and has a cut length of 7.562 plus or minus 0.093 inches, resulting in a preferred inner diameter of 2.305 plus or minus 0.032 internal diameter, with a weld joint to withstand a force of 33 pounds. Such a belt can be procured from Porter Cable Corporation, the assignee of the present application, under Part No. 878192. It will be recognized by those skilled in the art that other elastic belts or O-rings, both from the standpoint materials or dimensions, may well be suitable for varying designs and configurations employing the principals and general concept of the present brake system. Preferably, however, the friction set up by elastic belt 84 will prevent rotation of pad 22 when the motor is running and the pad is unconstrained by a workpiece surface while permitting a random orbit sanding motion when the pad comes in contact with the workpiece surface. However, should a preferred elastic belt become worn with use, or in an alternate configuration, it is possible that elastic bell 84 will have a tension to permit only slow rotation of the pad when the motor is running and the pad is unconstrained by the workpiece surface while permitting a random orbit sanding motion when the pad comes in contact with the workpiece surface. In either event, the present invention provides a desirable braking system for a random orbit sander, in order to prevent the undesirable gouging or scratching previously discussed. In particular, in an embodiment where elastic belt 84 has an appropriate tension to prevent rotation of pad 22 when the pad is unconstrained by a workpiece surface, the present braking system provide a unique, previously unavailable system which completely stops rotation of pad 22 when unconstrained by a workpiece surface. To the best of the applicant's knowledge, no such braking system has previously been available for a random orbit sander.

While a variety of configurations could be conceived by those skilled in the art, fixed pulley 80 in the embodiment shown comprises a flanged shaft fixed to sander body or housing 56 such as by a machine screw 86. Fixed pulley 80 in the preferred embodiment is configured with a shaft portion 88 having a diameter smaller than an outer flange 90, the recess or groove formed by the fixed pulley being defined by shaft 88, flange 90, and a housing surface 92 to which fixed pulley 80 is secured. Many other configurations for forming a groove or recess in a sander body or housing, or otherwise securing one end of elastic belt 84, could be configured by others skilled in the art.

Furthermore, although the recess or groove defined by at least one of the pad support 38 or pad 22 is defined in the preferred embodiment through a rabbet-shaped recess at the outer diameter of pad support 38, recess 82 in this embodiment being closed by the upper surface of pad support 22, those skilled in the art could envision many other ways of securing elastic belt 84 so that it prevents or slows rotation of pad 22 when the pad is not in contact with a workpiece surface. For example, a groove could be configured completely within pad support 38 or within a protrusion formed within pad 22. Furthermore, while the present braking system is illustrated in FIG. 8 in connection with a dustless version of a random orbit sander lower housing, such a braking system is equally useful with dusty versions of random orbit sanders, such as is illustrated in FIG. 1A.

The sanders shown in the present application comprise a skirt 52 which flares out over the periphery 54 of pad 22. As with housing 20, skirt 52 is preferably formed of a rigid material (for example, polyamide and is spaced slightly upward from pad 22, giving pad 22 sufficient clearance from skirt 52 so that the sander can operate properly and so that dust can be pulled up between the periphery of pad 22 and skirt 52 by fan blades 37. As previously indicated, fan blades 37 may be integrally formed in a central open region interior to counterweight 36.

In the preferred embodiment, skirt 52 is formed integrally with a lower housing 56, which is configured so that it can be selectively rotated about sander body 20 for enabling the lower housing to be oriented in a position desired by the user. The position selected by the user is typically maintained by friction between the exterior lower portion of the sander body 20 and the interior portion of lower housing 56, each of which have complementary shapes to ensure retention of the lower housing on the sander body while enabling rotational adjustment. The ability to adjustably position lower housing 56 is particularly advantageous when lower housing 56 comprises a dust collection system defining a dust exhaust channel such as 58. Such a dust exhaust channel may be coupled either to a passive dust collector such as a bag or filter housing 60 or by a hose to an active system such as a vacuum cleaner. In these scenarios, users may wish to adjust the position of the collection system with respect to sander or workpiece features.

Figure 2:
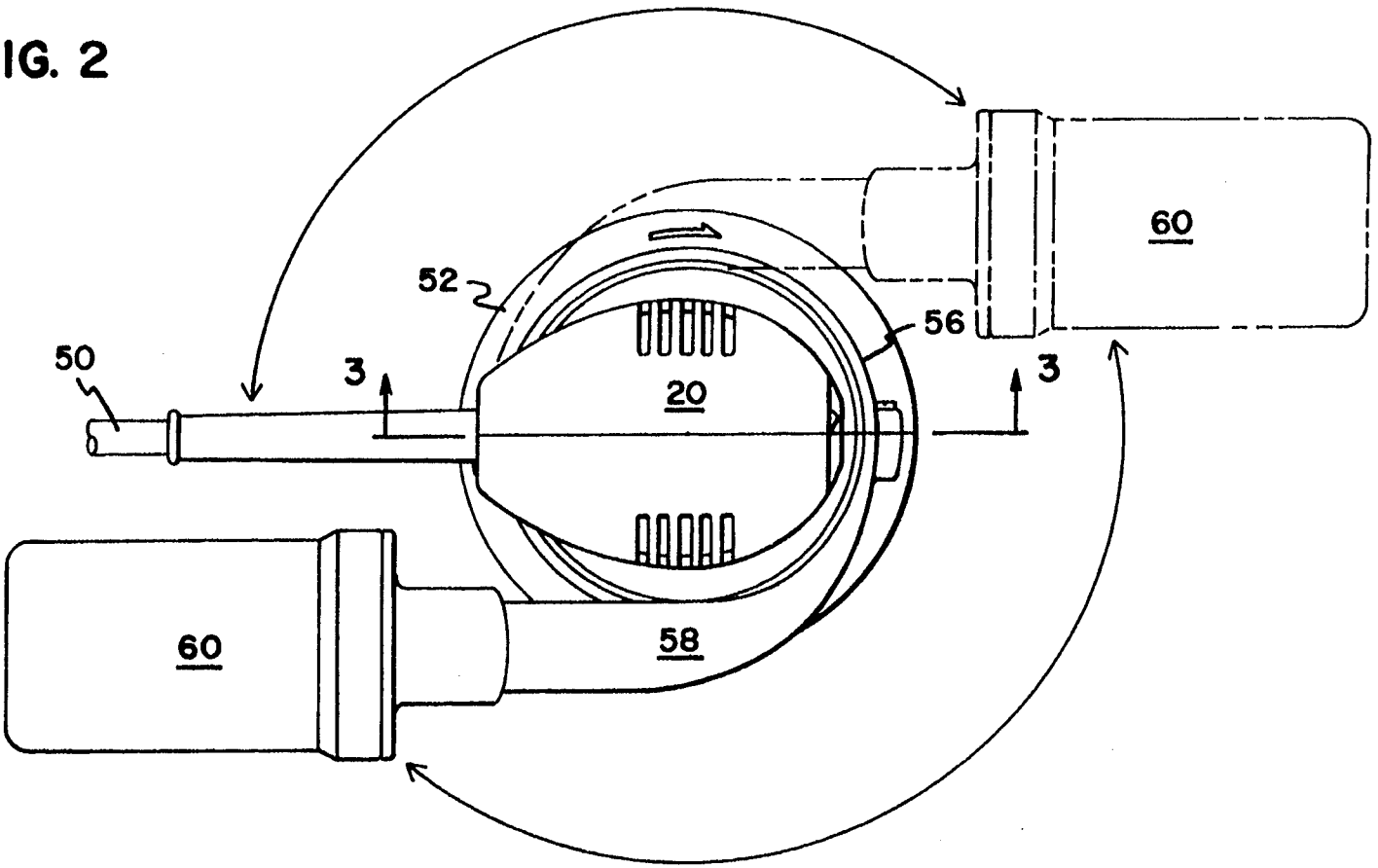
FIG. 2 is a top view of a sander showing a dust collection system which can be rotationally oriented in a direction selected by the user.

As with body 20, lower housing 56 may comprise two halves secured together by conventional means. For the version of the sander disclosed which incorporates dust collection, dust collection channel 58 is defined in part by a portion of lower housing 56. FIG. 2, which is a top plan view of the preferred sander embodiment comprising a passive dust collection system, illustrates how lower housing 56 may be selectively swivelled in a rotational manner to a position desired by the user. As can be seen, such positioning will enable the user to orient the direction of exhaust port 58 in a preferred direction relative to, for example, power cord 50.

Figure 4:
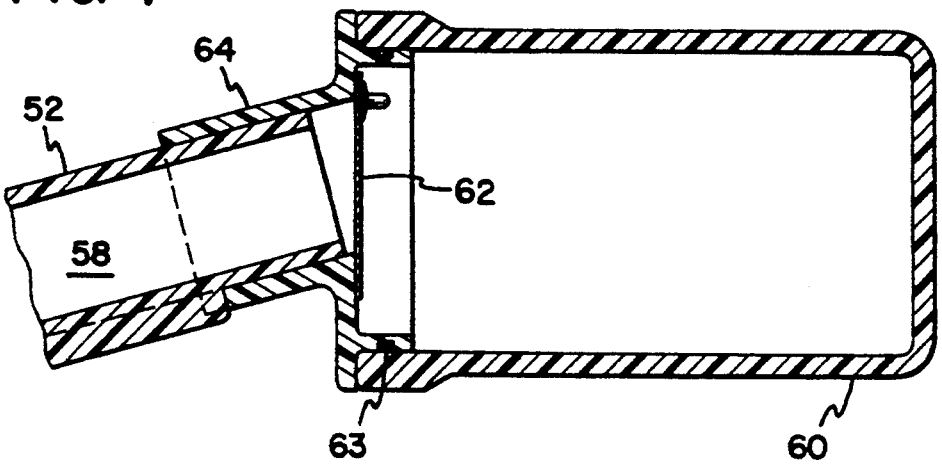
FIG. 4 illustrates a dust collection housing.
Figure 5:
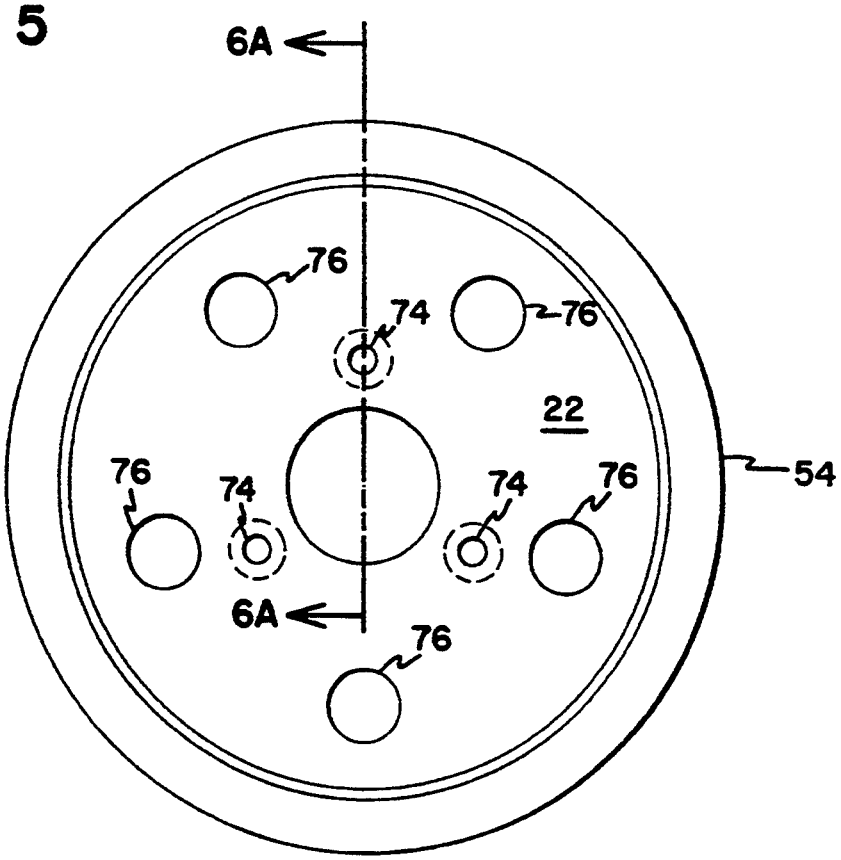
FIG. 5 illustrates a top plan view of a sanding pad which incorporates dust collection holes.
Figure 6A:
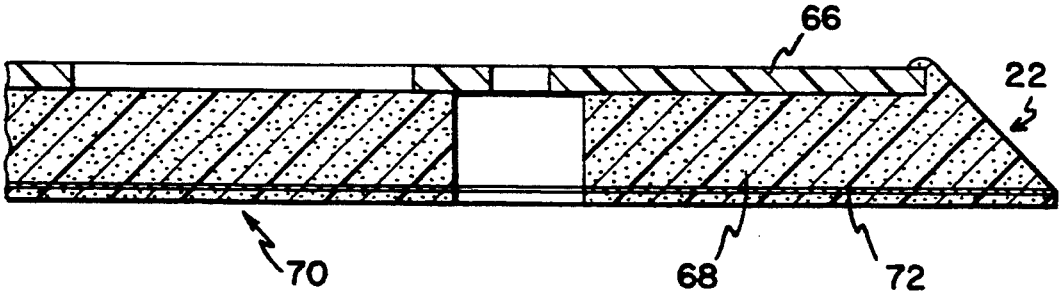
FIG. 6A and 6B illustrate alternative embodiments of a sander back-up pad.
Figure 6B:
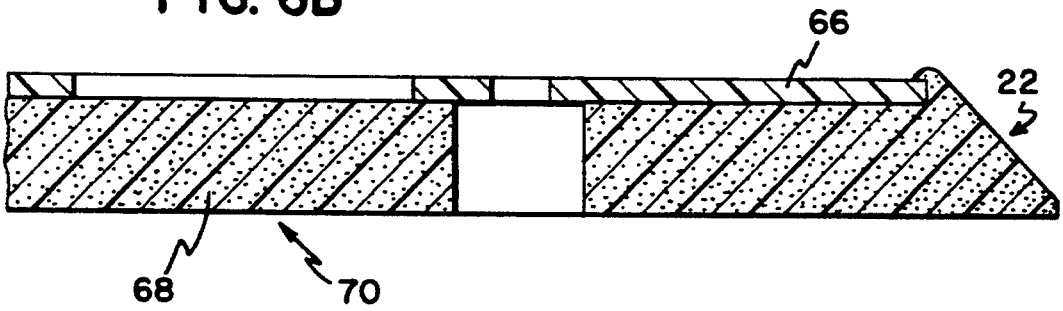

The preferred dust collection system is shown cross-sectionally in FIG. 4. Note that the preferred system incorporates a membrane 62 which maintains a normally closed position in order to prevent the back flow of dust collected within filter 60 while enabling dust to enter the filter. Membrane 62 may be formed of polyester film having a nominal thickness of 0.007 inch. Filter housing 60 is typically coupled via friction fit to an adapter 64, which in turn fits fictionally over dust exhaust channel 58 of housing 52 in order to removably interconnect the filter and adapter assembly with the sander exhaust port. O-ring 63 retained in place by a detent in adapter 64 helps maintain a good friction fit and seal for enabling long-life and easy removal of housing 60 from adapter 64. When filter housing 60 is full of dust, it can be removed from adapter 64 and emptied by simply twisting housing 60 off of adapter 64 and tapping the filter housing briefly in order to empty it of dust. Note that, during this emptying procedure, membrane 62 preferably remains with adapter 64 and does not interface with emptying filter housing 60.

In the preferred embodiment, filter housing 60 is formed by molding, sinterring or by other means a rigid, porous, plastic material, preferably porous polyethylene, polypropylene, polystyrene, or other polyolefins having a pore size effective to retain sanding dust; it has been found that a pore size of 120–140 microns is satisfactory. In the embodiment shown, filter housing 60 is substantially cylindrical and has an internal diameter of approximately two inches, a length of approximately four inches, and a typical wall thickness of 0.15 inch. Those skilled in the art will recognize that other sizes and shapes of sander filters consistent with the present filter invention may also be useful.

In the sander embodiments shown, pads 22 are typically five inches in diameter and comprise an upper member 66 of fiberglass-reinforced epoxy molded into a lower member 68, which may be formed of integral skin-cast polyurethane. As is familiar to those skilled in the art, for pads used with PSA, a vinyl sheet is typically applied to the lower surface 70 of lower pad member 68. This vinyl material is normally coated such that PSA sandpaper or the like will stick to the surface and yet, when the paper is removed, little or no abrasive will be present on the vinyl sheet. Pads 22 are typically rated for 13,000 RPM. PSA pads with lower surface 70 formed of vinyl or similar material may include an embossed grain applied in a mold (a surface familiar to those skilled in the art used with pressure-sensitive adhesive for adhering materials such as abrasive sheets to the pad). Alternatively, lower surface 70 may be formed of short-stemmed hook and loop material applied in the mold (a surface likewise familiar to those skilled in the art for use in connection with abrasive sheets or the like backed with hook and loop material).

In prior-art sander configurations operating in the random orbit mode, pad 22 is typically free of rotational restraint such that pad 22 may achieve a very high RPM when the motor is running and the sander is lifted off of the work. In such situations, if lower member 68 of pad 22 is formed of typical prior-art materials such as cast polyurethane foam, the pad may expand radially outward. Radial pad expansion in this manner can cause a sanding sheet adhered to the bottom face 70 of the pad to be released when PSA is used to bond the abrasive sheet to the pad. This release of the adhesive sheet has been found to be caused by the differential movement in the interface between bottom surface 70 of the pad and the adjoining layer of the adhesive sheet, resulting in release by the PSA of the sanding sheet. Such released abrasive sheets can be inconvenient to the user.

Accordingly, it has been found that use of an anti-radial-expansion mechanism coupled proximate the lower surface 70 of sanding pad member 68 can substantially prevent radial expansion of the pad and substantially eliminate the problem of PSA bonding failures between the pad and the adhesive sheet. In one preferred embodiment, the anti-radial-expansion system is achieved by molding a layer 72 of vinyl-coated fiberglass insect screening into the lower portion of pad member 68. Such insect screening may have a mesh of 18 by 16 strands per inch with a strand diameter of 0.011 inch. Other similar fiberglass screening or materials may also be used in order to prevent the previously described radial expansion problem. An alternative is use of a square-weaved cloth backing molded into the vinyl coating at the bottom of the pad.

Pads 22 are typically secured to pad support 38 by machine screws 48 passed through mounting holes 74 formed in upper fiberglass member 66. In sanding pads which comprise vacuum holes 76, the vacuum holes are preferably molded in and not machined.

At the time of filing the present application, preferred embodiments of the sanders disclosed can be obtained from Porter-Cable Corporation, the assignee of the present application, in three models. A model 332 does not incorporate dust collection and includes a PSA pad. A model 333 includes a dust collection system as well as a hook and loop pad. A model 334 is similar to the model 333 except that it incorporates a PSA pad. Models will soon be available incorporating the preferred braking system.

The present invention is to be limited only in accordance with the scope of the appended claims, since persons skilled in the art may devise other embodiments still within the limits of the claims.

What is claimed is:

1. A random orbit sander, comprising:

a. sanding means for providing a random orbit sanding function, the sanding means comprising a sander body, a pad for supporting sandpaper, a motor housed by the sander body, and random orbit coupling means for coupling the motor to the pad in order to impart a random orbit sanding motion to the pad when the motor is running and the sander in use on a workpiece surface, the coupling means comprising pad support means for providing support to the pad, the pad support means being coupled to the motor through a bearing system, at least one of the pad support means and the pad defining a first groove;

b. a member attached to the sander body, the member defining a second groove; and c. an elastic belt stretched between the two grooves.

2. The sander of claim 1 wherein the first groove is defined by an upper surface of the pad interfaced with a rabbet-shaped recess defined in the pad support means.

3. The sander of claim 1 wherein the member comprises a fixed pulley.

4. The sander of claim 1 wherein the member comprises a flanged shaft fixed to the sander body, the second groove being defined by the shaft, a surface of the sander body, and the flange.

5. The sander of claim 1 wherein the elastic belt has a tension to prevent rotation of the pad when the motor is running and the pad is unconstrained by the workpiece surface while permitting a random orbit sanding motion when the pad comes in contact with the workpiece surface.

6. The sander of claim 1 wherein the elastic belt has a tension to permit only slow rotation of the pad when the motor is running and the pad is unconstrained by the workpiece surface while permitting a random orbit sanding motion when the pad comes in contact with the workpiece surface.

7. A random orbit sander and braking system comprising:

a. a random orbit sanding system including a motor coupled to a sanding pad by a subsystem which imparts a random orbit sanding motion of the pad on a workpiece surface; and b. a brake system which is operatively coupled to the sanding system and which prevents rotation of the pad when the motor is running and the pad is unconstrained by the workpiece surface while permitting the random orbit sanding motion when the pad comes in contact with the workpiece surface.

8. The random orbit sander and braking system of claim 7 wherein the braking system comprises:

a. a first groove defined by a first portion of the sanding system;

b. a second groove defined by a second portion of the sanding system; and c. an elastic belt stretched between the two grooves.

9. A random orbit sander and braking system comprising:

a. random orbit sanding means including a motor coupled to a sanding pad for imparting random orbit sanding motion of the pad on a workpiece surface; and b. brake system means operatively coupled to the sanding means for preventing rotation of the pad when the motor is running and the pad is unconstrained by the workpiece surface and for permitting the random orbit sanding motion when the pad comes in contact with the workpiece surface.

10. The random orbit sander and braking system of claim 9 wherein the brake system means comprises:

a. a first groove defined by a first portion of the sanding means;

b. a second groove defined by a second portion of the sanding means; and c. an elastic belt stretched between the two grooves.

11. A random orbit sander and brake system, comprising:

a. a sander body;

b. a motor housed by the sander body;

c. a pad support coupled to the motor through a bearing system;

d. a pad supported by the pad support;

e. at least one of the pad support and the pad defining a first recess;

f. a portion of the sander body defining a second recess; and h. an elastic belt stretched between the two recesses.

12. The sander and brake system of claim 11 wherein the first recess is defined by an upper surface of the pad interfaced with a rabbet-shaped recess defined in the pad support.

13. The sander and brake system of claim 11 wherein the second recess is defined by a fixed pulley attached to the sander body.

14. The sander and brake system of claim 13 wherein the fixed pulley comprises a flanged shaft fixed to the sander body, the second recess being defined by the shaft, a surface of the sander body, and the flange.

15. The sander of claim 11 wherein the elastic belt has a tension to prevent rotation of the pad when the motor is running and the pad is unconstrained by a workpiece surface while permitting a random orbit sanding motion when the pad comes in contact with the workpiece surface.

16. The sander of claim 11 wherein the elastic belt has a tension to permit only slow rotation of the pad when the motor is running and the pad is unconstrained by a workpiece surface while permitting a random orbit sanding motion when the pad comes in contact with the workpiece surface.

17. A random orbit sander and brake system, comprising:

a. a sander body;

b. a motor housed by the sander body;

c. a pad support coupled to the motor through a bearing system;

d. a pad supported by the pad support; and e. an elastic belt stretched between the sander body and at least one of the pad support and the pad.

18. The random orbit sander and brake system of claim 17 wherein:

a. at least one of the pad support and the pad define a first recess;

b. the sander body comprises a member which defines a second recess; and c. the elastic belt is stretched between the two recesses.

19. The sander and brake system of claim 18 wherein the first recess is defined by an upper surface of the pad interfaced with a rabbet-shaped recess defined in the pad support.

20. The sander and brake system of claim 18 wherein the member comprises a fixed pulley attached to the sander body.

21. The sander and brake system of claim 20 wherein the fixed pulley comprises a flanged shaft fixed to the sander body, the second recess being defined by the shaft, a surface of the sander body, and the flange.

22. The sander of claim 17 wherein the elastic belt has a tension to prevent rotation of the pad when the motor is running and the pad is unconstrained by a workpiece surface while permitting a random orbit sanding motion when the pad comes in contact with the workpiece surface.

23. The sander of claim 17 wherein the elastic belt has a tension to permit only slow rotation of the pad when the motor is running and the pad is unconstrained by a workpiece surface while permitting a random orbit sanding motion when the pad comes in contact with the workpiece surface.

* * * * *